US006969133B2

(12) United States Patent
Compagnucci

(10) Patent No.: US 6,969,133 B2
(45) Date of Patent: Nov. 29, 2005

(54) MULTI-PURPOSE ELEMENT FOR SLIDING METAL RACKS LOCATED INSIDE FURNITURE

(75) Inventor: Rossano Compagnucci, Osimo (IT)

(73) Assignee: Compagnucci-S.p.A., Santa Maria Nuova (IT)

( * ) Notice: Subject to any disclaimer, the term of this patent is extended or adjusted under 35 U.S.C. 154(b) by 212 days.

(21) Appl. No.: 10/048,143

(22) PCT Filed: Jun. 4, 2001

(86) PCT No.: PCT/IT01/00284

§ 371 (c)(1),
(2), (4) Date: Jan. 23, 2002

(87) PCT Pub. No.: WO01/93722

PCT Pub. Date: Dec. 13, 2001

(65) Prior Publication Data

US 2002/0124348 A1 Sep. 12, 2002

(30) Foreign Application Priority Data

Jun. 6, 2000 (IT) ..... MC2000A0049

(51) Int. Cl.[7] ..... A47B 88/00

(52) U.S. Cl. ..... 312/334.6; 312/348.4

(58) Field of Search ..... 312/334.27, 348.1, 312/348.2, 348.4, 330.1, 334.6, 334.7

(56) References Cited

U.S. PATENT DOCUMENTS

| | | | | | |
|---|---|---|---|---|---|
| 2,276,942 | A | * | 3/1942 | Dibble | 108/143 |
| 3,220,364 | A | * | 11/1965 | Sandin | 108/147.16 |
| 4,470,642 | A | * | 9/1984 | Gasperin | 384/19 |
| 5,466,061 | A | * | 11/1995 | Lautenschlager | 312/348.2 |
| 5,486,046 | A | * | 1/1996 | Jernstrom et al. | 312/408 |
| 5,564,807 | A | * | 10/1996 | Rock et al. | 312/331 |
| 6,637,848 | B2 | * | 10/2003 | Lin | 312/334.23 |

FOREIGN PATENT DOCUMENTS

EP 1 023 859 A2 * 1/2000

* cited by examiner

*Primary Examiner*—Janet M. Wilkens

(57) ABSTRACT

A multi-purpose element for sliding metal racks located inside furniture, consisting in a box-type bar with upturned-U cross section that acts both as bearing structure for the body of the rack and as protection cover for the telescopic guides of the rack.

4 Claims, 2 Drawing Sheets

MULTI-PURPOSE ELEMENT FOR SLIDING METAL RACKS LOCATED INSIDE FURNITURE

CROSS REFERENCE TO RELATED APPLICATIONS

Not applicable.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISC

Disc not applicable.

BACKGROUND OF THE INVENTION

1. Field of the Invention

The present patent application for industrial invention relates to an element for sliding racks made of metal wire and located inside furniture, in particular modular kitchen cabinets.

2. Description of Related Art

As it is known, kitchen cabinets are commonly equipped with removable internal racks, whose bottom consists in a grid obtained by soldering multiple rod irons, while the bearing structure is usually made up of a frame obtained with metal profiles or pressed metal plates suitably shaped to act as slide guides.

An additional inconvenience of practical nature is represented by the fact that the use of these telescopic guides requires the presence of suitable means to fix the guides to the rack frame.

BRIEF SUMMARY OF THE INVENTION

The main purpose of the present invention is to provide a solution to both inconveniences, through the realisation of an element capable of acting as cover for the telescopic guides and at the same time as connection element between guides and rack.

BRIEF DESCRIPTION OF THE DRAWINGS

For major clarity the description of the multi-purpose element for sliding metal racks according to the present invention continues with reference to the enclosed drawings, which are intended for purposes of illustration and not in a limiting sense, whereby.

DETAILED DESCRIPTION OF THE INVENTION

Figure 1:
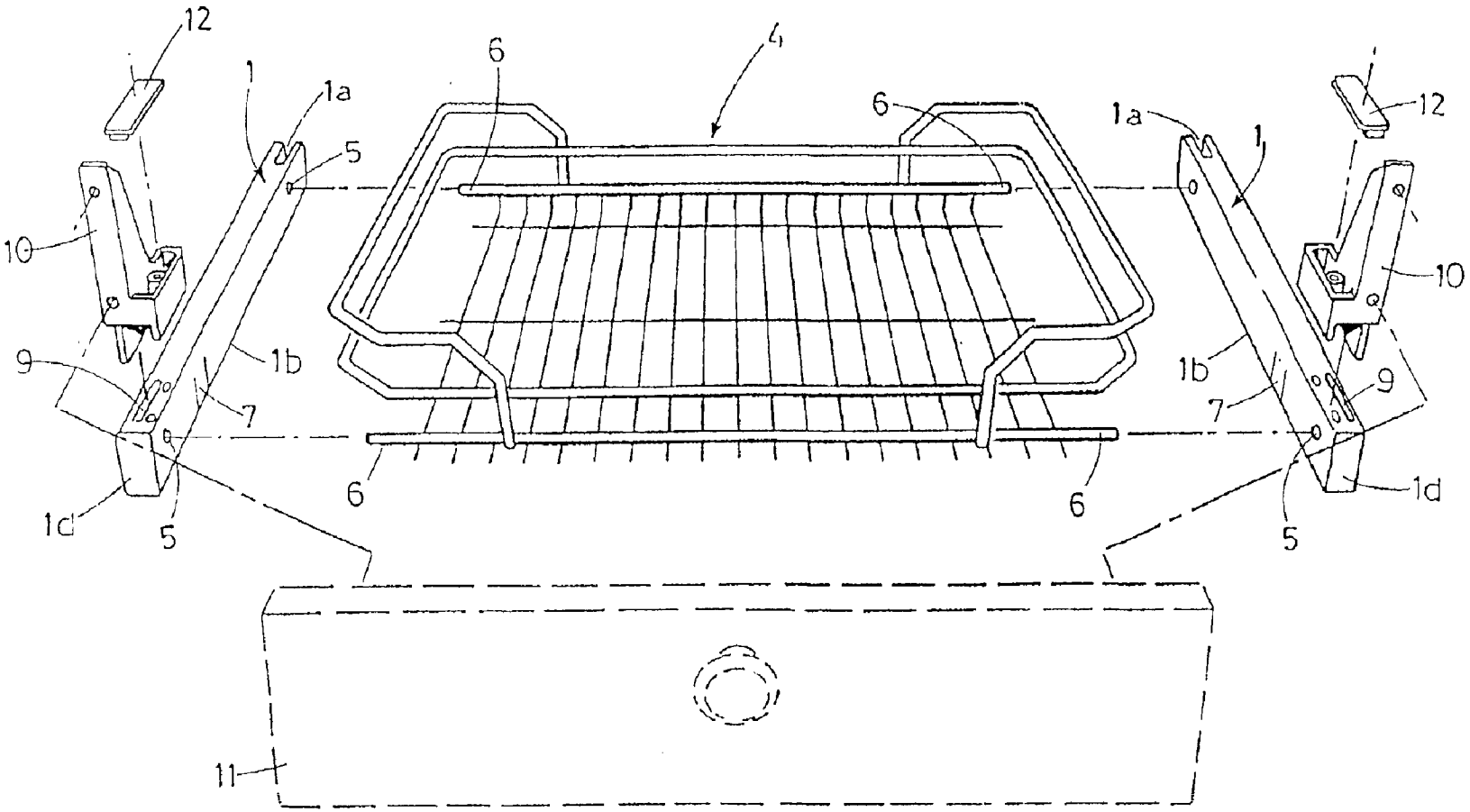
FIG. 1 is an exploded perspective of a metal rack with two box-type bars with upturned-U cross section mounted on the sides.
Figure 4:
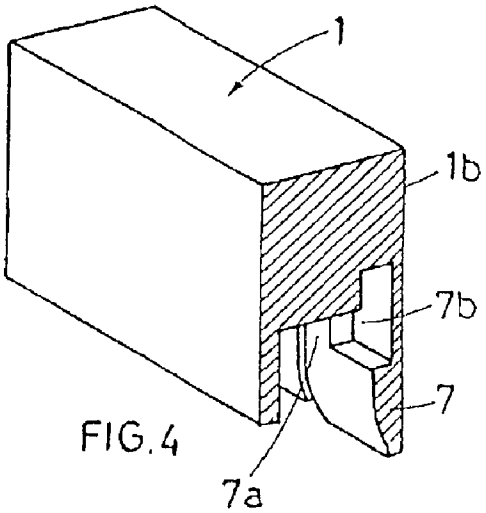
FIG. 4 is a section of the box-type bar with plane IV—IV of FIG. 3.
Figure 2:
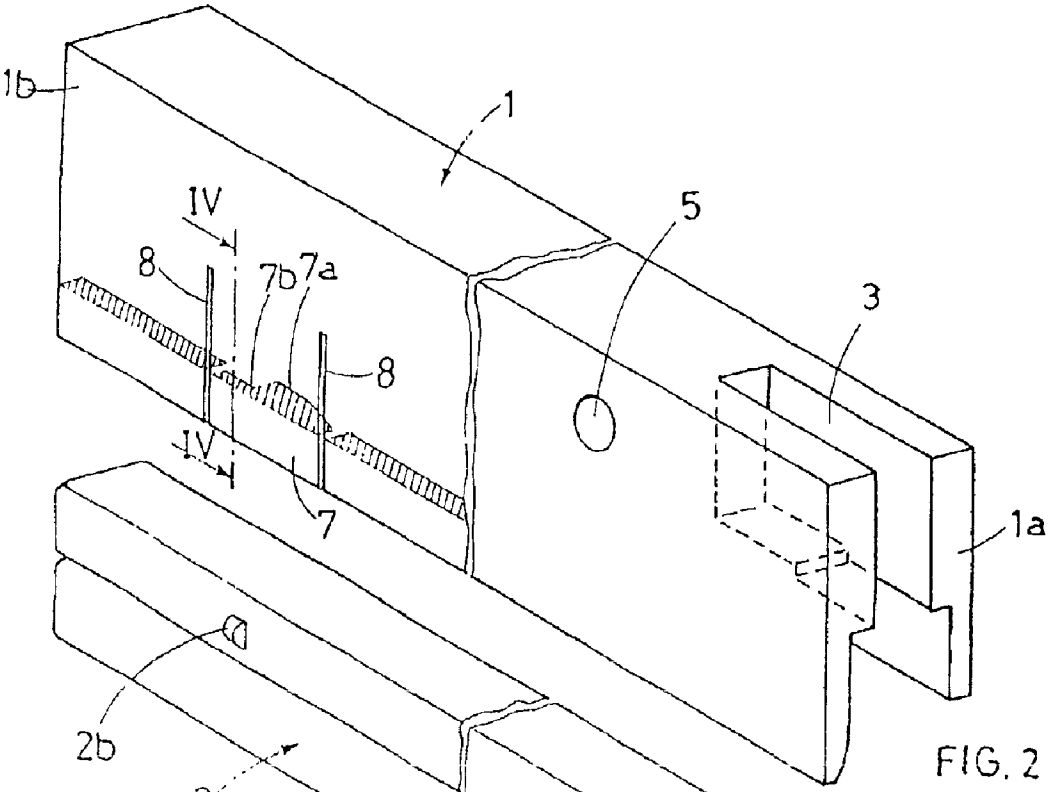
FIG. 2 is an axonometric view of one box-type bar with upturned-U cross sections seen from the back, that is from the opening for the telescopic guide.

With particular reference to FIGS. 2 and 4, the multi-purpose element for sliding metal racks according to the present invention consists in a box-type bar (1) with upturned-U cross section that can exactly house and hide a telescopic guide (2) of known type.

What is claimed is:

1. Multi-purpose elements in combination with a sliding metal rack, the elements each consisting of in a box-type bar (1) with upturned-U cross section, a telescopic guide (2) being housed within the box-type bar (1), the guide having an internal wall having a tooth **(2*b*) formed thereon, the metal rack (4) having two sides on a body, one box-type bar (1) being fixed to each of the two sides of the metal rack (4), becoming an integral part of the metal rack (4), acting as bearing structure of the body of the metal rack (4), each box-type bar (1) being provided with means for preventing each box-type bar from overturning and exiting from the guide (2), the guide being provided with means for cooperating with the preventing means on each box-type bar, an anti-loosening means of consists an elastically flexible tongue (7) located on an inner wall of each box-type bar (1), the inner wall of the box-type bar being provided with two notches (8) capable of isolating the flexible tongue (7), the flexible tongue (7) having an internal face having a section (7*a*) with higher thickness provided with a seat (7*b*) that can house the tooth (2*b*) located on the internal wall of the guide (2)**.

2. Multi-purpose elements in combination with a sliding metal racks the elements each consisting of a box-type bar (1) with upturned-U cross section, a telescopic guide (2) being housed within the box-type bar (1), the metal rack (4) having two sides on a body, one box-type bar (1) being fixed to each of the two sides of the metal rack (4), becoming an integral part of the metal rack (4), each box-type box acting as bearing structure of the body of the metal rack (4), each bar (1) having on a front end **(1*d*) an upper wall, a seat (9) being provided on the upper wall and including a bracket (10) which is fitted and tightened on an internal face of a front panel (11)** to obtain a drawer with the metal rack as an internal compartment.

3. Multi-purpose elements in combination with a sliding metal rack, the elements each comprising a box-type bar (1) with an upturned-U cross section, a telescopic guide (2) being housed within the box-type bar, the metal rack (4) having two sides on a body, one box-type bar (1) being fixed to each of the two sides of the metal rack (4), an upturned hook **(2*a*) being formed on an upper surface of the telescopic guide (2), each box-type bar (1) having an opening on a rear end (1*e*) thereof, a niche (3) being formed within the opening near the rear end of each box-type bar, the upturned hook (2*a*) engaging the niche (3)** when the telescopic guide has been completely inserted into the respective box-type bar such that vertically separation of each box-type bar and the rack attached thereto from the telescopic guide is prevented.

4. Multi-purposes element in combination with a sliding metal rack, the elements each comprising a box-type bar (1) with an upturned-U cross section, a telescopic guide (2) being housed within the box-type bar, the metal rack (4) having two sides on a body, one box-type bar (1) being fixed to each of the two sides of the metal rack (4), an upturned hook **(2*a*) being formed on an upper surface of the telescopic guide (2), each box-type bar (1) having an opening on a rear end (1*e*) thereof, a niche (3) being formed within the opening near the rear end of each box-type bar, the upturned hook (2*a*) engaging the niche (3) when the telescopic guide has been completely inserted into the respective box-type bar such that vertically separation of each box-type bar and the rack attached thereto from the telescopic guide is prevented, each telescopic guide further having an internal wall having a tooth formed thereon, an elastically flexible tongue (7) located on a wall of each box-type bar, the wall of each box-type bar being provided with two notches (8) capable of isolating the flexible tongue, the flexible tongue having an internal face having a section (7***a*) with a higher thickness provided with a seat (7*b*) that can house the tooth located on the internal wall of the guide such that the guide is automatically stopped inside the bar and longitudinal separation of the guide from the box-type bar is prevented.

* * * * *

UNITED STATES PATENT AND TRADEMARK OFFICE

CERTIFICATE OF CORRECTION

PATENT NO. : 6,969,133 B2
APPLICATION NO. : 10/048143
DATED : November 29, 2005
INVENTOR(S) : Rossano Compagnucci It is certified that error appears in the above-identified patent and that said Letters Patent is hereby corrected as shown below:

In column 2, after line 4 and before line 5, insert the following:

"The rear end (1a) of the box-type bar (1) is open in order to act as entrance for the telescopic guide (2), which is provided with a hook (2a) capable of fitting into the niche (3) suitably located in the rear end of the bar (1), as shown in FIG. 2.

Once the guide (2) has been completely inserted into the bar (1), the hook (2a) automatically hooks the bar (1) that can no longer be detached from the guide (2) fixed inside the two sides of the cabinet by simply lifting it upwards.

The box-type bar (1) is mounted on both sides of a metal rack (4), becoming an integral part of the structure of the rack (4).

The coupling of the bars (1) to the guides (2) through the hook (2a) eliminates any risk of overturning the rack at the end of the extraction travel.

In the preferred embodiment of the invention, a lateral side (1b) of the bar (1) has some holes (5) (only two in this specific case), in which the ends of an equivalent number of rod irons (6) are forced, becoming an integral part of the rack (4).

This means that the metal rack manufacturer will provide the furniture maker in charge of installing the metal racks in the cabinets with a metal rack (4) already provided with two lateral bearing bars (1).

Signed and Sealed this

Fifth Day of September, 2006

JON W. DUDAS
*Director of the United States Patent and Trademark Office*

UNITED STATES PATENT AND TRADEMARK OFFICE

CERTIFICATE OF CORRECTION

PATENT NO. : 6,969,133 B2
APPLICATION NO. : 10/048143
DATED : November 29, 2005
INVENTOR(S) : Rossano Compagnucci It is certified that error appears in the above-identified patent and that said Letters Patent is hereby corrected as shown below:

In column 2, after line 4 and before line 5, insert the following:

The furniture maker will only need to fix the telescopic guides (2) inside the two sides of the cabinet.

The installation of the rack (4) inside the cabinet is very simple.

Once the guide (2) has been inserted into the open rear end (1a) of the bar (1), the rack (4) can be pushed forward to completely insert the two guides (2) into the two bars (1). Each bar (1) is provided with a coupling latch in order to automatically stop the guide (2) inside the bar (1) at the end of its forward travel.

The coupling latch prevents the rack (4) from exiting from the guides (2).

Figure 3:
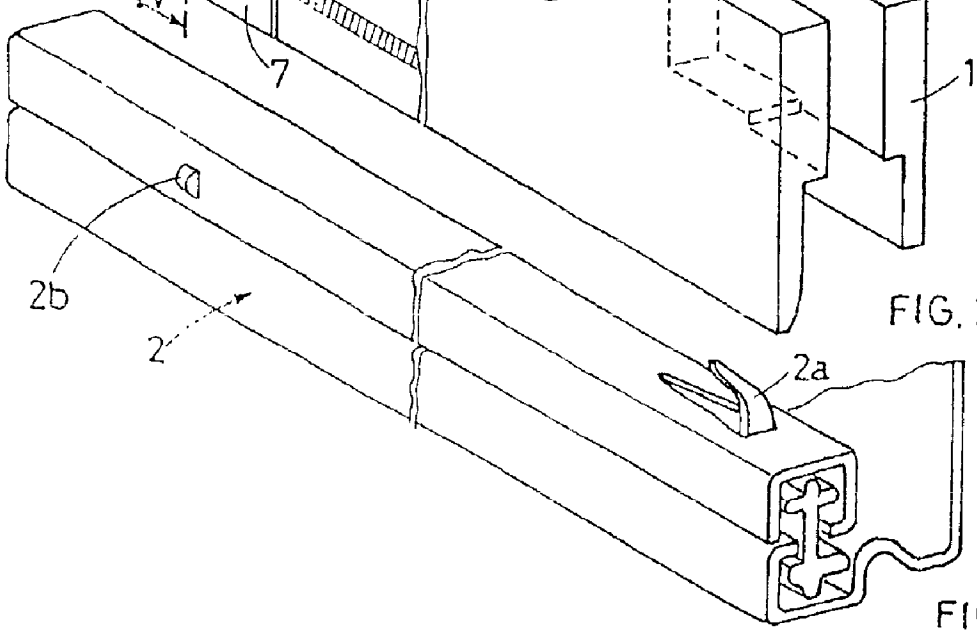
FIG. 3 is an axonometric view of an ordinary telescopic guide to be inserted and hidden inside each box-type bar with upturned-U cross section.

With particular reference to FIGS 3 and 4, it must be noted that the coupling latch is made up of an elastically flexible tongue (7) located on a wall of the bar (1) provided with two notches (8) capable of isolating the intermediate tongue (7).

The internal face of the tongue (7) has a section (7a) with higher thickness provided with a seat (7b) that can house the tooth (2b) located on the internal wall of the guide (2).

When the guide (2) is inserted inside the bar (1), the tooth (2b) interferes with the section (7a) causing the elastic outward flexion of the tongue (7), that snaps back into its idle position as soon as the tooth (2b) passes over the section (7a) and fits into the seat (7b).

On its front end (1d), on the upper wall, the bar (1) is provided with a seat (9) in which a special bracket (10) can be fitted and tightened on the internal face of the front panel (11), to obtain a drawer with a metal rack in its internal compartment.

The description above clearly shows the multi-purpose function of the bar (1) that can act as:

bearing structure for the body of the metal rack (4);

protection over for the telescopic guides (2);

support element for brackets (1) used to correct the rack (4) to the front panel (11 of a drawer;

UNITED STATES PATENT AND TRADEMARK OFFICE

CERTIFICATE OF CORRECTION

PATENT NO. : 6,969,133 B2
APPLICATION NO. : 10/048143
DATED : November 29, 2005
INVENTOR(S) : Rossano Compagnucci It is certified that error appears in the above-identified patent and that said Letters Patent is hereby corrected as shown below:

support element for frames, sides or edges used to realise high racks or racks with multiple shelves."

In column 2, line 6, after "of" and before "a box-type", delete "in".

In column 2, line 18, after "consists" and before "20, insert therein "of".

In column 2, line 54, change "Multi-purposes element" to read "Multi-purpose elements".

In column 4, line 4, after "from the" and before "bar-type", insert "respective".

Signed and Sealed this

Second Day of January, 2007

JON W. DUDAS
*Director of the United States Patent and Trademark Office*